US007687978B2

(12) United States Patent
Hosea et al.

(10) Patent No.: US 7,687,978 B2
(45) Date of Patent: Mar. 30, 2010

(54) TANDEM CONTINUOUS CHANNEL ELECTRON MULTIPLIER

(75) Inventors: Kiki H. Hosea, Amherst, MA (US); Matthew L. Breuer, Hadley, MA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 659 days.

(21) Appl. No.: 11/362,661

(22) Filed: Feb. 27, 2006

(65) Prior Publication Data

US 2009/0127994 A1 May 21, 2009

(51) Int. Cl.
*H01J 43/04* (2006.01)

(52) U.S. Cl. ..... 313/103 CM; 313/105 CM

(58) Field of Classification Search ..... 313/103 CM, 313/105 CM, 105 R; 250/214 VT
See application file for complete search history.

(56) References Cited

U.S. PATENT DOCUMENTS 3,128,408 A 4/1964 Goodrich et al.
3,665,497 A * 5/1972 Deradorian et al. ..... 313/103 R
4,757,229 A 7/1988 Schmidt et al.
5,086,248 A 2/1992 Horton et al.
5,367,218 A 11/1994 Comby
6,384,519 B1 * 5/2002 Beetz et al. ..... 313/103 CM
2002/0096632 A1 * 7/2002 Kaji et al. ..... 250/305

FOREIGN PATENT DOCUMENTS

GB 981659 1/1965

OTHER PUBLICATIONS

International Search Report, Jul. 16, 2007, IPO, 1 page.

* cited by examiner

*Primary Examiner*—Karabi Guharay
(74) *Attorney, Agent, or Firm*—Cantor Colburn LLP

(57) ABSTRACT

A channel electron multiplier including a single channel CEM for receiving an input particle. A multi-channel CEM is positioned after the single channel CEM for receiving emissions from the single channel CEM. An electron collector is positioned after the multi-channel CEM for generating a pulse current in response to emissions from the multi-channel CEM.

3 Claims, 7 Drawing Sheets

TANDEM CONTINUOUS CHANNEL ELECTRON MULTIPLIER

BACKGROUND OF THE INVENTION

Channel electron multipliers (CEMs) are used to amplify charged particle, photon, or energetic neutral particle signals. CEMs are used to detect photons, charged particles both positive and negative, and energetic neutral particles. They are used as detectors in mass spectrometers as well as in surface analyzers such as auger and x-ray/ultraviolet photoelectron spectrometers, and are also employed in electron microscopes. In addition, they can also be used for electron multiplication in a photon multiplier application.

The CEM makes use of an emissive surface to generate electron multiplication. The emissive surface will emit secondary electrons when struck by a charged particle, or energetic neutral particle, or photon, with sufficient energy. This process is repeated and generates an electron avalanche down the length of the channel. An electron collector, such as a Faraday cup, at the end of the channel collects the electrons and converts them into an electrical pulse.

Typical CEMs are tubular in nature and have an integral funnel cone attached to the input beam end to increase input beam profile detection. CEMs having single and multiple channels in one body have been commercialized. A single channel CEM has a shorter output current dynamic range than a multiple channel CEM having the same channel resistance per channel. The stability and lifetime of CEMs depend on the active emissive surface area. Therefore, a single channel CEM lifetime is shorter. In addition, the single channel CEM high output current operation is less stable than a multiple channel electron multiplier. However, a multiple channel electron multiplier suffers losses in detection efficiency due to an inactive area between the channels at the input beam end. In a single channel electron multiplier, the detection efficiency is maximized due to a smooth transition between the funnel cone and the channel.

There is a need in the art for a CEM providing high detection efficiency and increased lifetime.

BRIEF SUMMARY OF THE INVENTION

An embodiment of the invention is a channel electron multiplier including a single channel CEM for receiving an input particle. A multi-channel CEM is positioned after the single channel CEM for receiving emissions from the single channel CEM. An electron collector is positioned after the multi-channel CEM for generating a pulse current in response to emissions from the multi-channel CEM.

DETAILED DESCRIPTION

Figure 1:
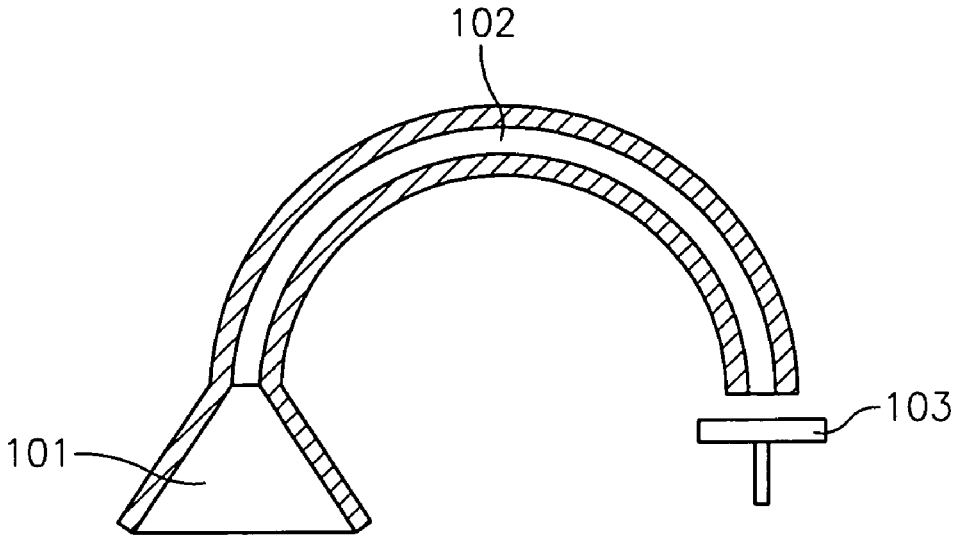
FIG. 1 depicts a conventional single channel CEM.
Figure 2:
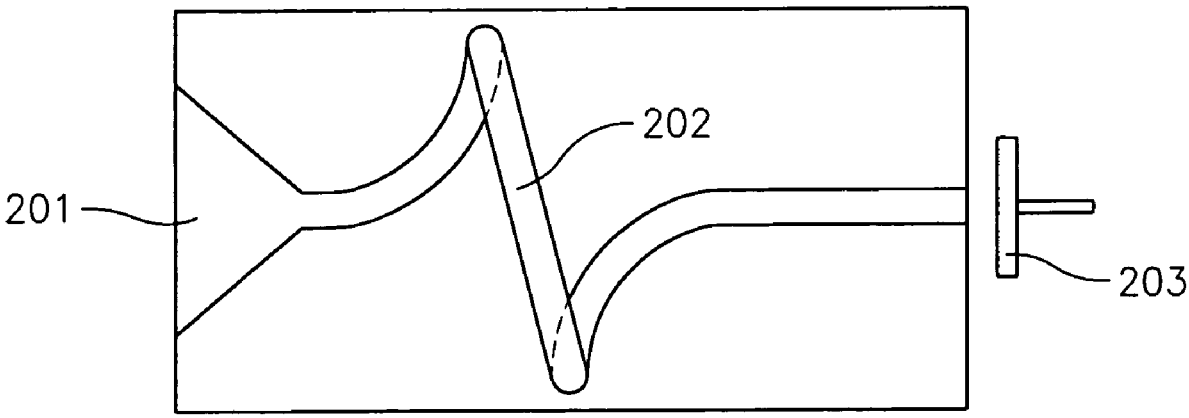
FIG. 2 depicts a conventional single channel CEM.
Figure 3B:
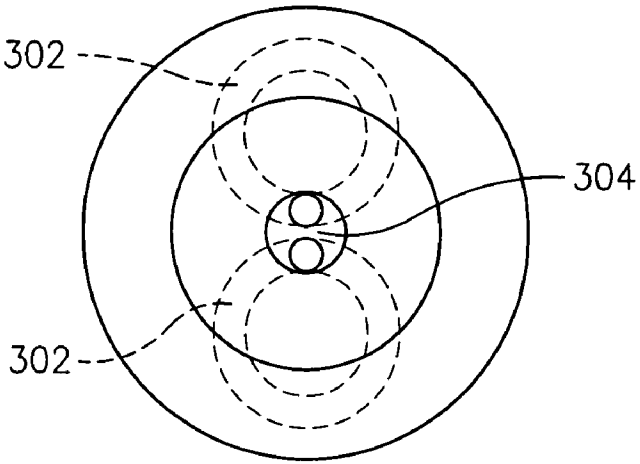
FIGS. 3A and 3B depict a conventional multi-channel CEM.
Figure 3A:
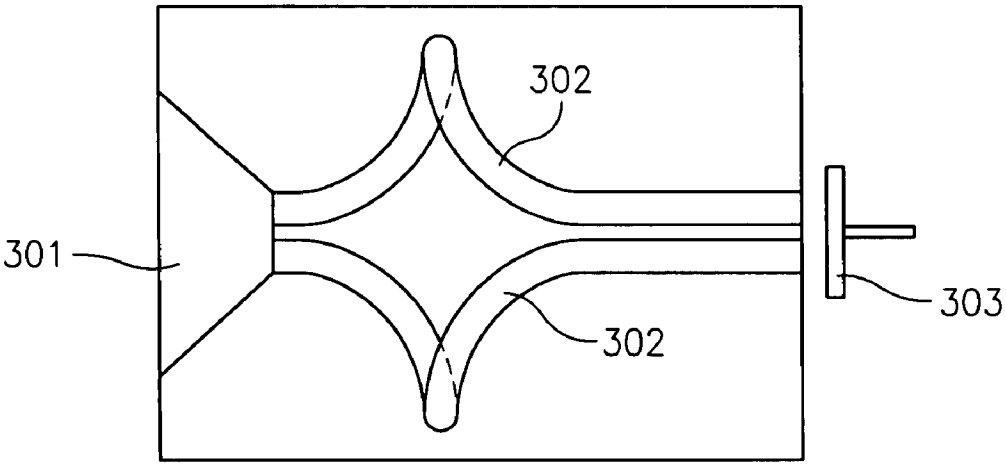

FIG. 1 shows an exemplary conventional CEM. Most CEMs include an input funnel cone 101, a curved tubular channel 102, and a Faraday cup 103 as shown in FIG. 1. FIG. 2 shows an alternate CEM having an input funnel 201, spiraled, tubular channel 202 and Faraday cup 203. FIG. 3A depicts a conventional CEM having an input funnel 301, multiple curved channels 302 and Faraday cup 303. FIG. 3B is a front view of the CEM in FIG. 3A.

Figure 4:
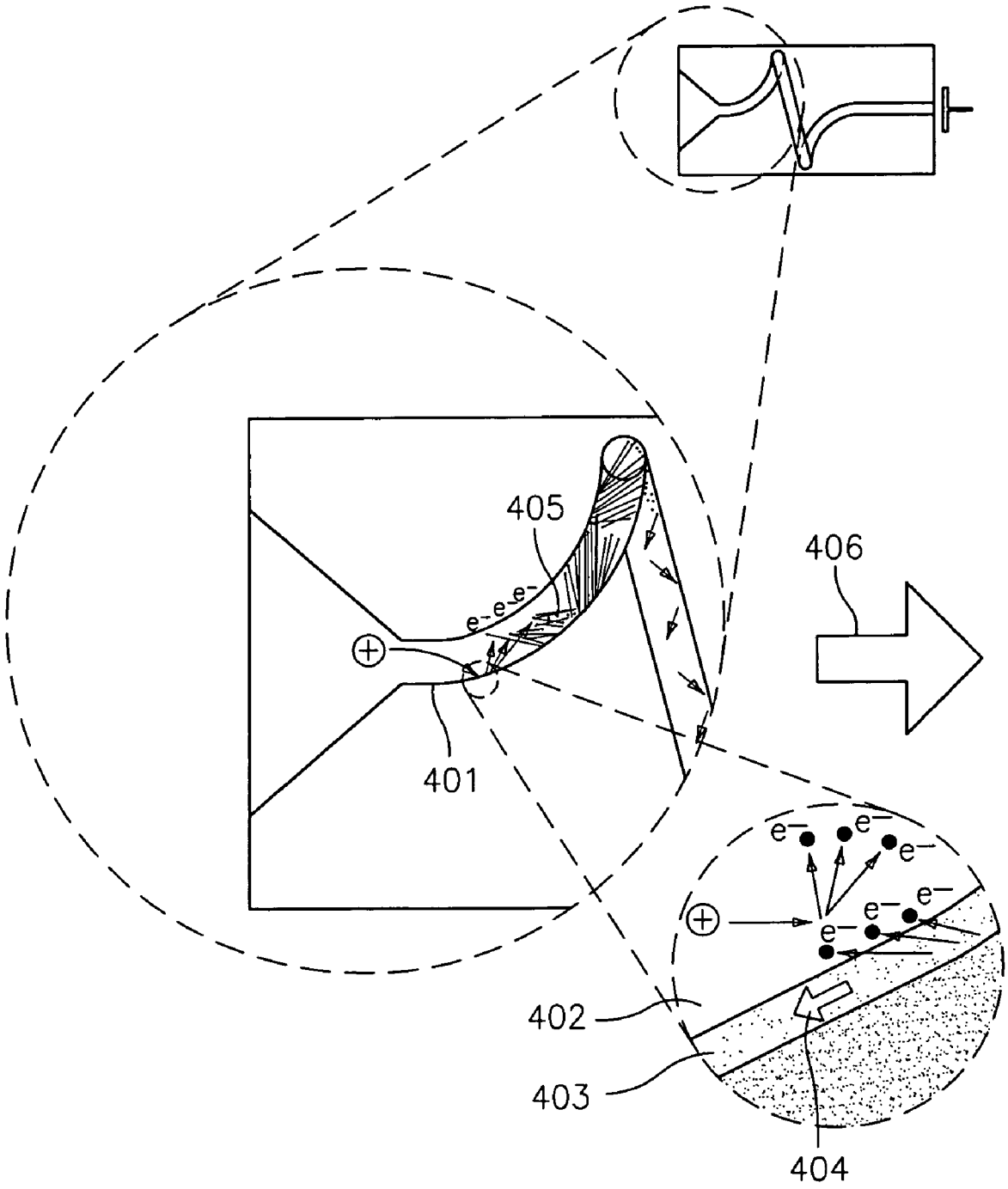
FIG. 4 illustrates electron avalanche in a CEM.

FIG. 4 is an enlarged view of a portion of FIG. 2 illustrating the operation of the CEM. The CEM inside channel wall 401 is prepared with an electron emissive layer 402, most commonly $SiO_2$, on top of a semi-conducting layer 403, most commonly reduced lead-oxide glass. The funnel cone 201 attached to the tubular channel 202 increases detection sensitivity due to a larger incoming particle beam profile acceptance.

When a charged particle, photon, or energetic neutral particle strikes the surface of the input end of a CEM, secondary electrons are generated which are then propelled into the channel by an applied electric field. This electric field drives the secondary electrons farther into the channel and the electrons again collide with the wall channel, further producing a large number of secondary electrons. This process repeats several times and creates an electron avalanche along the channel. A Faraday cup 203 at the output end collects the electrons and converts them into an electric pulse 406 which is fed into electronic circuitry for further signal processing. Electrons ejected from the channel walls of the multiplier are replenished by the electrical current 404 through the semi-conducting glass. The electric current 404 illustration shows the electric current pointing from the more positively biased back end of the CEM, the Faraday cup end, toward the more negatively biased front end of the CEM, the funnel cone end, and is in keeping with generally accepted convention. However, it is commonly understood that the electrons are flowing from the front end toward the back.

Multiple-channel CEMs have been manufactured, such as illustrated in FIG. 3; however, in this configuration, detection efficiency is decreased. Even with the presence of an input funnel cone 301, most of the secondary electrons generated by incoming particles that strike the area 304 between the channel openings and do not enter the channels. Thus, no electron multiplication is generated by particles striking area 304 and the ion signal is considerably weakened. In contrast, the single-channel CEM, as illustrated in FIGS. 1 and 2, does not exhibit loss of particle detection due to the smooth structural transition between the funnel cone 101, 201 and the channel 102, 202. Over time, charged particle bombardment of the channel walls causes a gradual degradation of the wall surface. Thus, the CEM lifetime is directly proportional to the total surface area of the channel walls. However, the multi-channel CEM of FIG. 3A offers a stable and wider dynamic range of the output current, due to channel multiplicity (provided that there exists equal resistance, per channel, or equal bias strip current, per channel) when compared to single-channel units of FIGS. 1 and 2. The multi-channel CEM of FIG. 3A also has a longer lifetime, due to an active channel wall emissive layer 402 surface area that is larger than that found in single-channel CEM designs.

Embodiments of the invention constitute a performance improvement over existing CEMs, of both the single-channel and multi-channel varieties, by way of a tandem configuration that joins a single-channel with a multi-channel CEM configuration. The single-channel is positioned at the particle beam input end, followed by the multi-channel CEM arrangement at the electron avalanche output end.

Figure 5A:
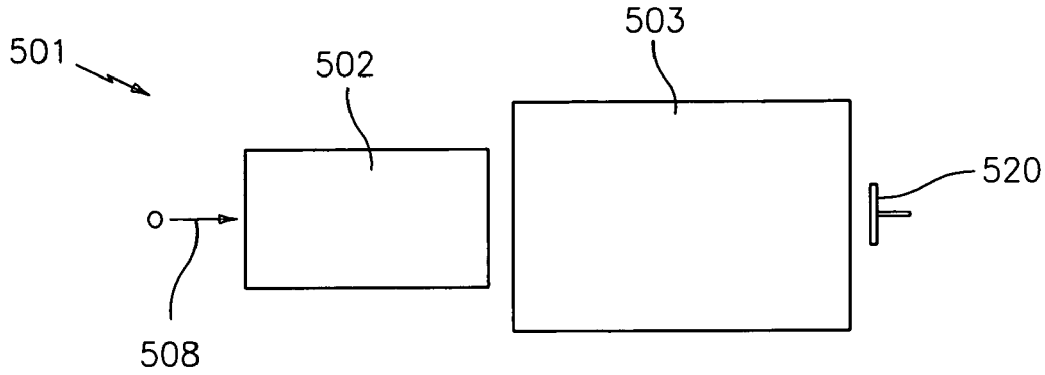
FIGS. 5A-5C illustrate multi-stage, tandem CEMs in embodiments of the invention.

FIG. 5A illustrates a tandem CEM configuration 501 in embodiments of the invention. The tandem CEM 501 includes a single channel CEM 502, and a multiple channel, single body CEM 503. The multiple channels in the single body CEM 503 may be tubular channels, and curved as shown in FIG. 3A. The incoming beam of charged particles 508 is received at a funnel (not shown) and triggers an electron avalanche along the single channel CEM 502. The output electron emission from the single channel CEM 502 is received at the multiple channels of the single body CEM 503. The electron emission is collected at an electron collector (e.g., Faraday cup) 520.

Figure 5B:
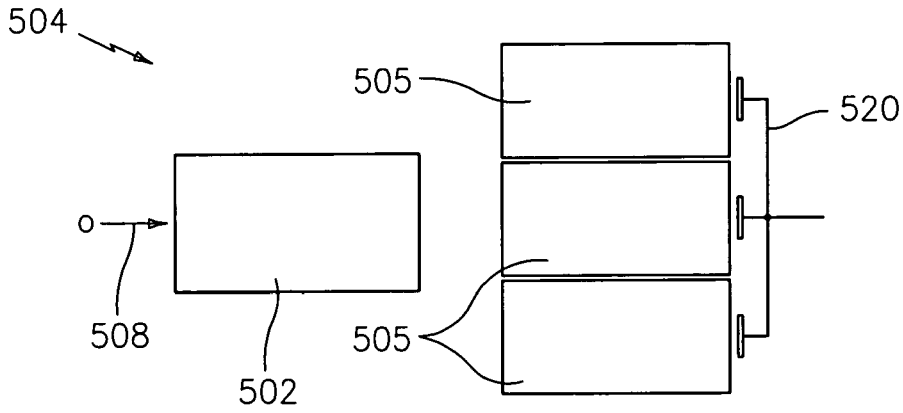

FIG. 5B illustrates a tandem CEM configuration 504 in alternate embodiments of the invention. Tandem configuration 504 includes a single channel CEM 502 followed by multiple, single body CEM units 505. CEM units 505 may be single-channel or multiple-channel devices. The incoming beam of charged particles 508 is received at a funnel (not shown) and triggers an electron avalanche along the single channel CEM 502. The output electron emission from the single channel CEM 502 is received at the CEM units 505. The electron emission is collected at electron collectors (e.g., Faraday cup) 520 each positioned at the output end of the CEM units 505.

Figure 5C:
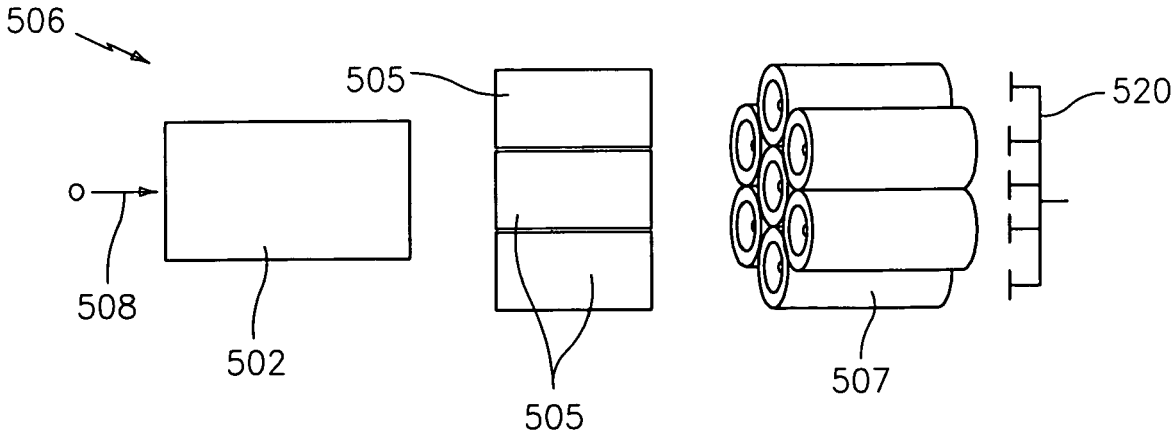

FIG. 5C illustrates a tandem CEM configuration 506 in alternate embodiments of the invention. Tandem configuration 506 includes a single channel CEM 502 followed by multiple, single body CEM units 505. CEM units 505 may be single-channel or multiple-channel devices. A third stage array of CEM units 507 is positioned after CEM units 505. CEM units 507 may be single-channel or multiple-channel devices. The incoming beam of charged particles 508 is received at a funnel (not shown) and triggers an electron avalanche along the single channel CEM 502. The output electron emission from the single channel CEM 502 is received at the CEM units 505. The output electron emission from the CEM units 505 is received at the CEM units 507. The electron emission of CEM units 507 is collected at electron collectors (e.g., Faraday cup) 520 each positioned at the output end of the CEM units 507. The tandem CEM configurations in FIGS. 5A-5C provide CEM configurations capable of delivering stable, high current output, and long lifetime, with high particle detection efficiency.

In the tandem configures of FIGS. 5A-5C, a distance is needed between the single channel CEM and the multi-channel CEM. The workable distance between the two depends on the inter channel distance on the multi-channel CEM input end. In exemplary embodiments, the inter channel distance is 0.1" center to center and the workable distance between the single channel CEM and the multi channel CEM is 0.1" to 0.75". In general, the spacing between the single channel CEM output end and the multi-channel CEM input end needs is determined based on the inter channel spacing of the channels in the multi-channel CEM. In embodiments of the invention, the single channel CEM and subsequent multi-channel CEM(s) are contained in a common housing, in a monolithic construction.

In above-described tandem configurations of a single-channel CEM followed by a multi-channel CEM, the single-channel CEM provides high detection efficiency, and the multi-channel CEM gives stable, high output current and longer lifetime. The electron avalanche produced by an input particle at the single-channel CEM end spreads all over the input surface area of the multi-channel. Even though some electrons are lost at the multi-channel input region, due to detection inefficiency in the area between channels, enough electrons are propelled into the channels to sufficiently generate an electron avalanche through the multi-channel CEM, which then arrives at the Faraday cup. In this case, the information of a single particle, input into the overall detector configuration, is preserved.

Figure 6:
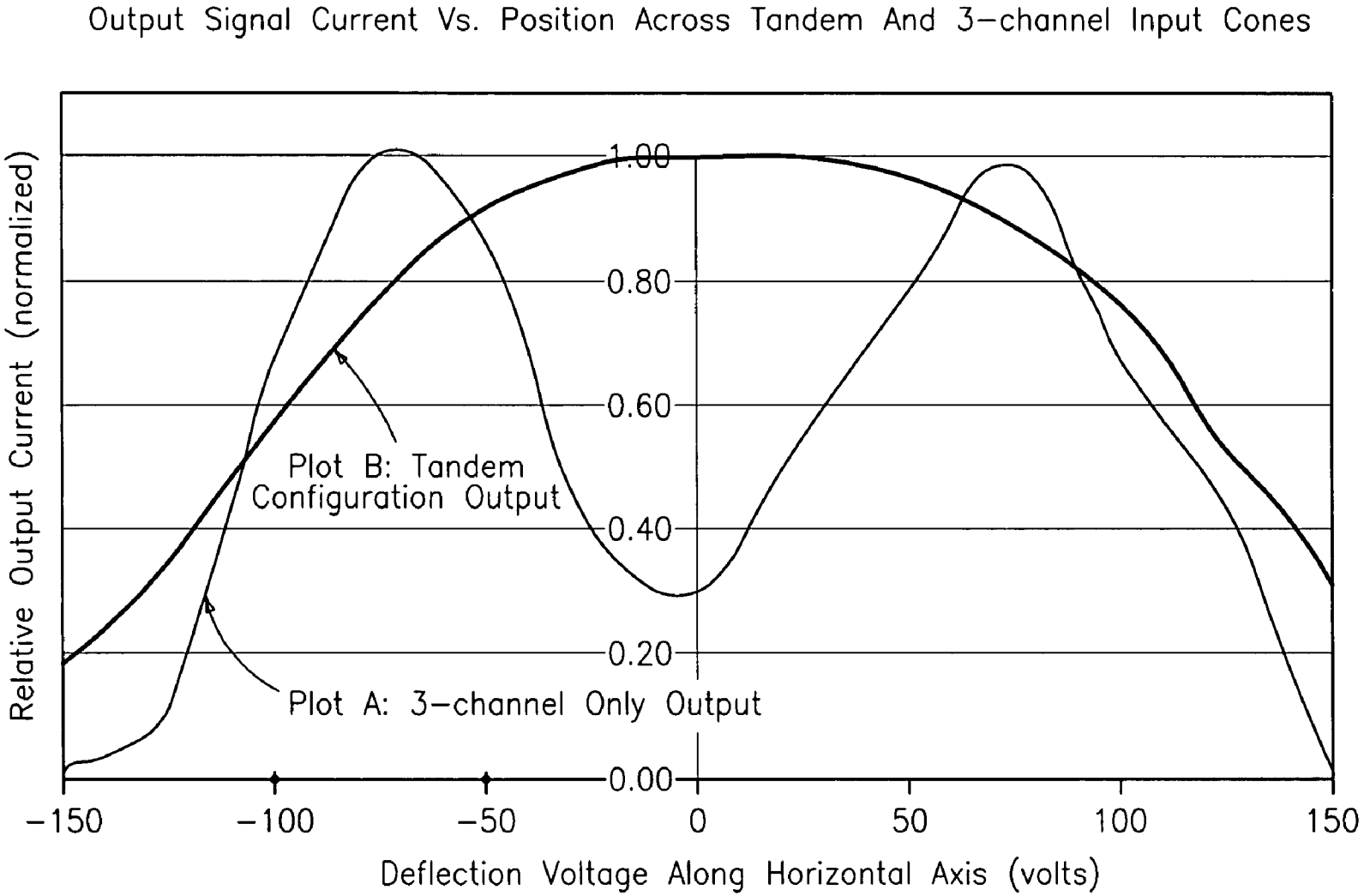
FIG. 6 is a graph of deflection voltage versus relative output current.

FIG. 6 is a graph of deflection voltage versus relative output current. In FIG. 6, plot A represents the output signal from a 3-channel CEM only, resulting from a horizontal input beam scan, by means of voltage controlled deflection plates, across the input cone of the CEM, through a plane containing the beam axis. The beam axis is co-linear with the axis of the 3-channel CEM. In plot A, the scan intersects two of the three input channels, which intersections are represented by the two peaks at approximate deflection positions −75V and +75V. The sharp decrease in the output current between these two peaks is a direct result of the losses occurring from the input beam being scattered off the space between the channels. Plot B is a plot of the output from the tandem CEM configuration, using the same input beam scan scheme as for the multi-channel CEM. Plot B shows there are essentially no losses across the tandem configuration input cone in the region where the losses are greatest in the multi-channel CEM. This is a clear indication the use of a single-channel input multiplier, in a tandem CEM configuration, eliminates the losses that would otherwise occur were the beam to be introduced directly into a detector consisting of only a multiple-channel CEM.

Figure 7:
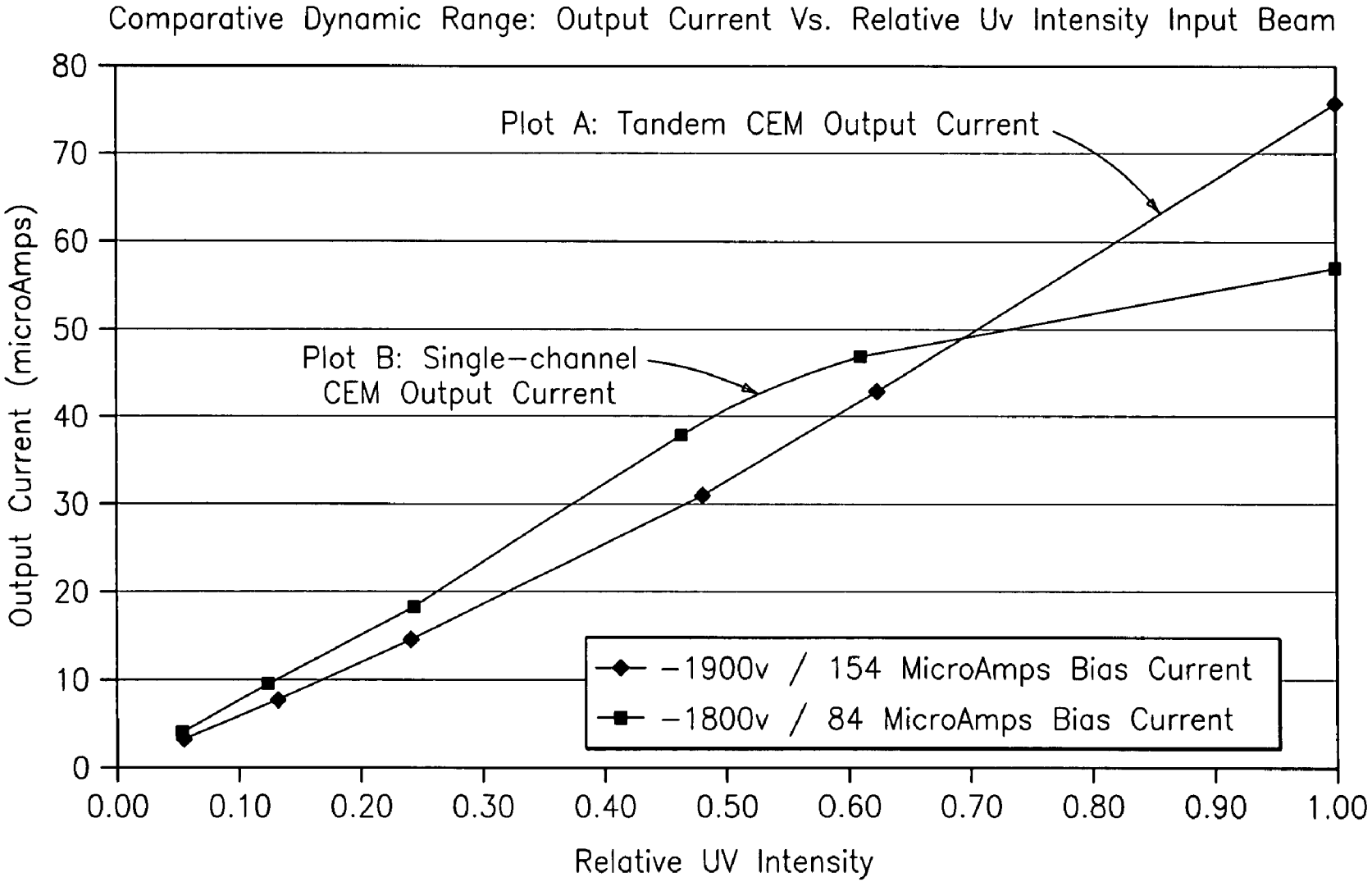
FIG. 7 is a graph of relative UV intensity versus output current.

FIG. 7 is a graph of relative UV intensity versus output current for single-channel CEM and a tandem CEM. Plot B shows output current for the single channel CEM. Plot A shows output current for the multi-stage, tandem CEM. As illustrated in FIG. 7, the tandem CEM provides higher dynamic range for the output current. In this graph the tandem CEM output current response, as a function of signal input (relative UV intensity), is higher than that of a single channel CEM, even though the bias strip current per channel, in the tandem, is 1.6 times lower than that of a single channel CEM. It is clearly seen that the single channel CEM saturates at about 45 microAmps. This is a direct verification that channel multiplicity in the tandem continuous CEM is capable of producing an output current larger than that of single-channel CEMs operating at a relatively comparable gain.

Figure 8:
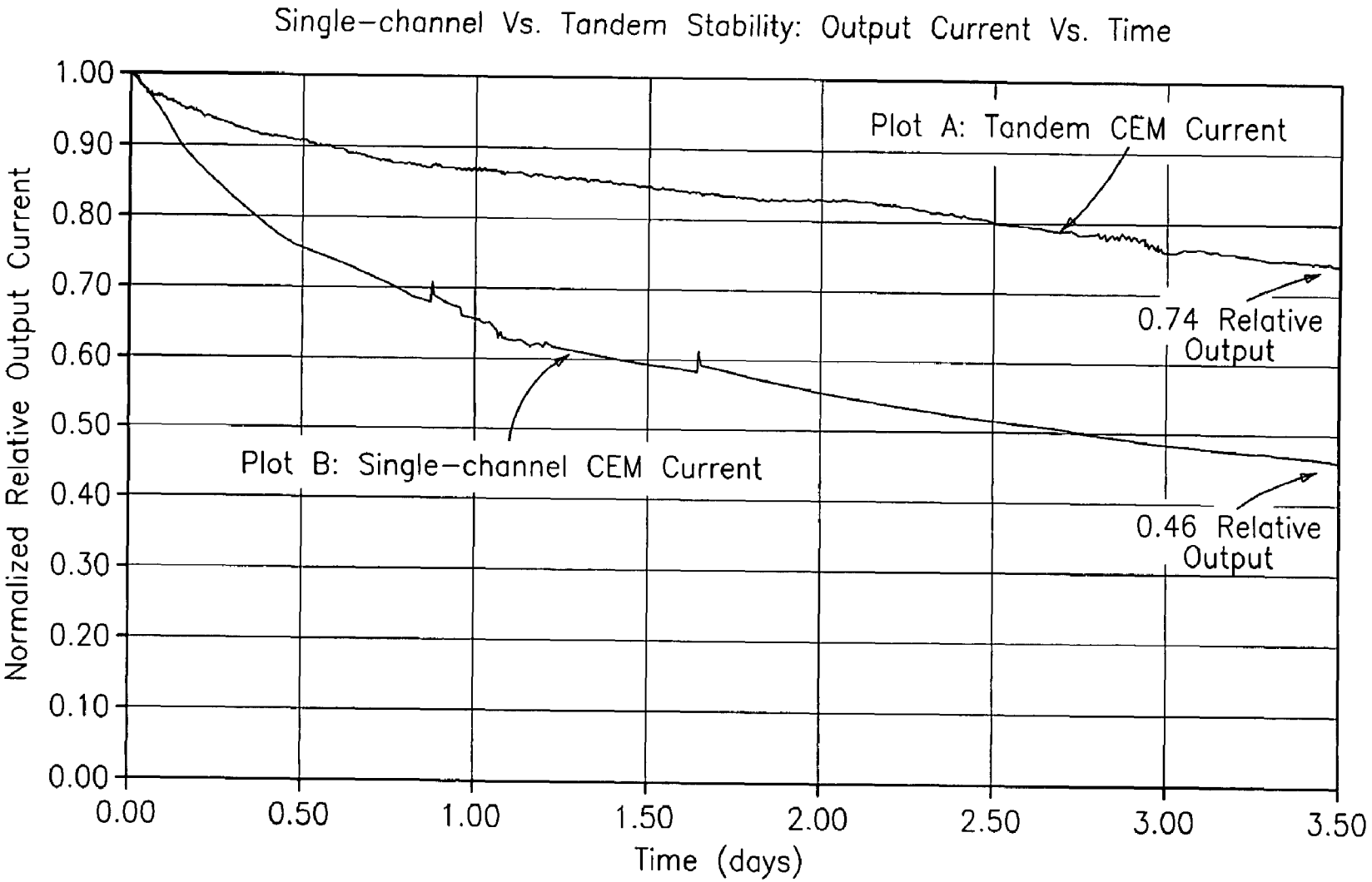
FIG. 8 is a graph of time versus normalized relative output current.

FIG. 8 is a graph of time versus normalized relative output current. Plot A corresponds to a tandem CEM and plot B corresponds to a single-channel CEM. FIG. 8 confirms that the tandem CEM configuration is capable of sustaining expectedly higher output currents for longer periods of time than a single-channel CEM working under comparable operating conditions. Operating continuously over a period of 3.5 days the tandem CEM configuration remains at 74% of its initial output, compared to only 46% of initial output by the single-channel CEM. This indicates that a detector lifetime increase, by a factor of 1.6, has been achieved through use of the tandem CEM configuration. This is a result of the larger total channel surface area due to using the multiple channels.

Embodiments of the invention overcome difficulties inherent in both single channel multipliers, and multiple channel multipliers, by fabrication of a tandem configuration which incorporates both a single channel at the input beam end and multiple channels at the output end. The single channel electron multiplier contributes to high detection efficiency and the multi-channel electron multiplier maintains high output current (dynamic range) and output current stability, as well as yielding a long lifetime. In tandem configurations, the electron avalanche produced by an input particle at the single channel end spreads over the entire input area of the multiple channel input cone. Even though some electrons are lost on the surface area between the input ends of the multiple channels a quantity of electrons, more than sufficient to start electron avalanches in the multi-channel stage, do enter the multiple channels. Therefore, the information of a single input particle is preserved.

In this tandem configuration, the input beam end of the single channel is biased electrically so it is negative with respect to the output end of the multi-channel. Biasing is accomplished by the application of voltage across the overall length of the tandem configuration. The input end and the output end of the electron multiplier incorporate an electrical contact so that voltage can be applied to the channel. An input beam at the electron multiplier input end generates secondary electrons. These electrons, under the influence of the applied electric field, travel toward the output end of the multiple channels. Along the way they undergo repeated wall collisions and, overall, generate an electron avalanche that is then collected by a Faraday cup.

While the invention has been described with reference to exemplary embodiments, it will be understood by those skilled in the art that various changes may be made and equivalents may be substituted for elements thereof without departing from the essential scope thereof. Therefore, it is intended that the invention not be limited to the particular embodiments disclosed for carrying out the invention, but that the invention will include all embodiments falling within the scope of the appended claims.

What is claimed is:

1. A channel electron multiplier comprising:

a single channel CEM for receiving an input particle;

a multi-channel CEM positioned after the single channel CEM for receiving emissions from the single channel CEM, wherein the single channel CEM and multi-channel CEM are contained in a common housing, in a monolithic construction;

an electron collector positioned after the multi-channel CEM for generating a pulse current in response to emissions from the multi-channel CEM;

a funnel for directing the particle to the single channel CEM; and a further multi-channel CEM positioned after the multi-channel CEM for receiving emissions from the multi-channel CEM;

wherein the electron collector positioned after the further multi-channel CEM for generating a pulse current in response to emissions from the further multi-channel CEM;

wherein the multi-channel CEM includes a plurality of single body CEM units, the single body CEM units including multiple channels;

wherein a spacing between the single channel CEM and the multi-channel CEM is based on inter channel spacing of the channels in the multi-channel CEM.

2. The channel electron multiplier of claim 1 wherein:

the multi-channel CEM is a single body, multi-channel CEM.

3. The channel electron multiplier of claim 1 wherein:

the multi-channel CEM includes a plurality of single body CEM units, the single body CEM units including a single channel.

* * * * *